US005248457A

United States Patent [19]

Brasel et al.

[11] Patent Number: 5,248,457

[45] Date of Patent: Sep. 28, 1993

[54] METHOD FOR PRODUCING INTRICATELY SHAPED PARTICULATE BEARING PRECURSOR COMPONENTS WITH CONTROLLED POROSITY AND DENSITY

[75] Inventors: Gregory M. Brasel; Susan J. Brasel, both of Ballwin, Mo.

[73] Assignee: Megamet Industries, St. Louis, Mo.

[21] Appl. No.: 823,168

[22] Filed: Jan. 21, 1992

[51] Int. Cl.[5] ..... B28B 7/10; B29B 7/00; B29C 41/42; B29C 45/00

[52] U.S. Cl. ..... 264/39; 264/41; 264/86; 264/87; 264/109; 264/328.6; 264/328.8; 264/328.16; 264/334

[58] Field of Search ..... 264/39, 37, 41, 42, 264/44, 86, 87, 109, 328.1, 328.8, 328.6, 328.16, 334

[56] References Cited

U.S. PATENT DOCUMENTS

| | | | |
|---|---|---|---|
| 3,243,860 | 4/1966 | Whitaker et al. | 425/84 |
| 3,457,606 | 7/1969 | Pösch | 425/84 |
| 3,634,559 | 1/1972 | Haes et al. | 264/86 X |
| 3,672,641 | 6/1972 | Slaby | 425/84 X |
| 3,838,001 | 9/1974 | Greiner et al. | 425/84 X |
| 3,922,191 | 11/1975 | Witt et al. | 425/85 X |
| 4,160,633 | 7/1979 | Strawson et al. | 425/84 X |
| 4,224,264 | 9/1980 | Ort et al. | 264/54 |
| 4,609,682 | 9/1986 | Weber et al. | 264/51 X |
| 4,626,569 | 12/1986 | Waitkus et al. | 264/328.8 X |
| 4,747,983 | 5/1988 | Colombo | 425/84 X |
| 4,753,713 | 6/1988 | Gunderson | 425/84 X |
| 4,784,814 | 11/1988 | Diethelm et al. | 264/328.8 X |
| 4,908,172 | 3/1990 | Sterzel et al. | 264/86 X |
| 5,033,939 | 7/1991 | Brasel | 264/63 X |
| 5,059,387 | 10/1991 | Brasel | 419/19 X |
| 5,082,437 | 1/1992 | Matsushita et al. | 264/39 X |
| 5,124,102 | 6/1992 | Serafini | 425/84 X |

FOREIGN PATENT DOCUMENTS

| | | | |
|---|---|---|---|
| 62370 | 5/1977 | Japan | 264/328.8 |
| 1444152 | 12/1988 | U.S.S.R. | 264/86 |

*Primary Examiner*—Karen Aftergut

*Attorney, Agent, or Firm*—Polster, Lieder, Woodruff & Lucchesi

[57] ABSTRACT

Particulate bearing precursor components are formed into intricate shapes yet possess controlled porosity by injection molding a mixture of particulate materials, thermosetting condensation resins, and low temperature catalysts. The mixture, when flowed into a mold cavity of an appropriate shape and heated, initiates a curing reaction which binds particulates together with a film that leaves the space between the particulates open. A positive volume change occurs during cure, providing for a more uniform pressure profile in the part. Also, a condensate is produced during the curing step which, when vented from the mold in strategic locations, allows manipulation of the curing reaction. This provides the ability to affect local density in the vicinity of the vent. Thus, one can correct for artificially, or incorrectly induced density or porosity gradients, and improve dimensional accuracy and other attributes of the subsequent processing steps.

11 Claims, 4 Drawing Sheets

REGIME 1

REGIME 2

REGIME 3

POSITIVE WARPAGE IS CONCAVE DOWN TOWARDS THE MOLD BOTTOM:

NEGATIVE WARPAGE IS CONCAVE UP TOWARDS THE MOLD TOP:

METHOD FOR PRODUCING INTRICATELY SHAPED PARTICULATE BEARING PRECURSOR COMPONENTS WITH CONTROLLED POROSITY AND DENSITY

BACKGROUND OF THE INVENTION

This invention relates to particulate injection molding, and more specifically, to a method of controlling part density and dimensional accuracy of intricately shaped parts throughout the molding process.

I. Description of the Prior Art

It is desirable in many manufacturing processes to produce shaped parts having controlled porosity and density. These are then used as precursors for subsequent processing. The controlled porosity part may also be a final part itself, but usually production of this part is an intermediate step in the process. Or, the precursor is used to assist in manufacturing another article, which article is the objective of the process. By porosity control is meant that no porosity gradient exists from location to location within the part. Dimensional accuracy means the part's shape, as defined by dimensional metrology methods, is within specified dimensional tolerances. Usually, and especially when subsequent processing involves a heating step, porosity control and dimensional accuracy are related through the part's density. Porosity gradients and density gradients are related, and the two terms may be used nearly interchangeably. Porosity or density gradients are undesirable, especially if dimensional accuracy, part strength, gas permeability, heat sensitivity of the precursor, or other attributes are important during subsequent processing.

There are several known mechanisms by which precursors are produced. For example, large yet lightweight parts can be made of thermoplastic or thermosetting plastics having a solid exterior and a porous, foamed interior. The technology for producing such parts is a variant of plastic injection molding and is discussed in "New Methods Increase Design Freedom", Plastics World, Feb. 1991, Pg. 37. Generally these techniques involve the introduction of an immiscible gas, or a latently reactive solid, into a thermoplastic or thermosetting material. When injected into a mold cavity, a foam is created through the release of gas from a liquid species via a chemical or physical reaction. The thermosetting or thermoplastic material may also contain an amount of particulate material.

Another method for producing particulate bearing, porous shaped parts is to introduce into a thermoplastic, thermosetting, or a mixture of thermoplastic or thermosetting compounds, an amount of solid particulate material, the interstices of which eventually define the pore space of the precursor. The amount, shape, and size of the particulate is chosen so the mixture of particulates and plastics has sufficient fluid properties to be molded in a manner similar to molding the plastic without the particulate; i.e., by injection molding, extrusion, etc. Once the shape of the part is made using these techniques, the plastic residing in the interstices between particulate grains is removed through a variety of ways, for example, pyrolysis, solvent extraction, melt wicking, or combining with a reactive gas. The precursor thus is composed of a particulate material with open pores, and little or no plastic material.

Open pores, as used herein, means the pores of the part do not contain a species that would require an extra process step to remove. For example, if the pores contain water, they are considered open if subsequent processing of this component requires a heating step, and the water is removed without in any manner hindering the overall process.

Slip casting is another method. This involves mixing a particulate material (usually a fine, ceramic material) with a liquid material containing dispersants. This produces a dry, non-flowable material rendered flowable for a period of time during which it is flowed into a mold. The mold is then sufficiently porous to remove the liquid component, called the solvent, through its pore structure. Removal of the solvent causes the ceramic material to achieve a substantial green strength. The mold is subsequently removed from the part, leaving a porous part.

Cores and molds are made for use in castings by mixing sand as the particulate species with various binders The binders can be, for example, thermoplastic, thermosetting, organic oils, either foaming or non-foaming. But, unless they are of the foaming variety, the binder particulate mixture is not capable of being moved in a liquid manner and is usually blown or rammed into a mold. Once the mold is full, the binder is solidified using whatever means activates the particular binder in use, usually heat, but catalytic gasses or other catalytic additives are also used. Since the binder never occupied the entire pore space of the particulate to begin with, a porous precursor, the core or mold, is produced with the desired permeability and collapsibility for casting molten metal.

II. Disadvantages of the Prior Art

The relationship between precursor porosity and final dimensions arises when particulate preforms are heated in a process known as sintering to fuse the particles together. The relationship is based on three principles. (1) Since controlling porosity in a particulate filled part is the same as controlling the distribution of particulates from location to location in the part (the particulates having a mass), controlling porosity is equivalent to controlling density of the part. (2) Since the fusing together of the particulates in a porous part is accompanied by a decrease in porosity, and thus a decrease in volume of the part, less volume change occurs in high density locations compared to low density locations due to the low initial porosity of high density locations. (3) Since a change in volume of the part is easily and practically ascertained by the dimensional change or shrinkage of the part during sintering, non-uniform volume changes are manifested as non-uniform shrinkage. Therefore, non-uniform porosity yields non-uniform shrinkage. Non-uniform shrinkage will warp the part, or at least lead to out-of-tolerance dimensions of the final part.

For all the aforementioned processes, which utilize plastic materials to completely fill the space between the particulates, it will be understood that macro-scale average pore size can be controlled through material selection, mixing, or other parameters. Further, the distribution of pore sizes throughout the sections of a single part can only be effected by the external pressures acting on the fluid mass as it is flowed into and pressurized to fill the mold cavity. But pressures and stresses from within the material (or those, such as friction with the mold wall, that cannot be directly controlled) also exist. So does interaction of solidified and/or stratified layers of material with the mixture, this occurring at the mold/material interface. Also, there are varying solidification rates of the material due to variations in the time the material has been exposed to the mold, or the temperature differential in the mold environment. In addition, the externally applied pressure is used primarily as the external force moving the liquid material into the mold and filling the sections of the mold. As a result, its ability to achieve even density gradients is limited.

Improper control of any of the above listed factors sets a stress profile into the material when it solidifies or cures, and creates density gradients in the part when it is removed from the mold. This phenomenon is discussed in Gaspervich's article: "Practical Applications of Flow Analysis in Metal Injection Molding", *The International Journal of Powder Metallurgy,* Volume 27, No. 2, pp 133–139. Because of the potential of creating gradients, considerable effort is required when molding parts having tight dimensions to select with great accuracy the proper time sequences, filling pressures, temperatures, gate and runner arrangement and location, and other parameters to insure any resultant stress profile of the liquid mixture is as uniform throughout all the sections of the part as possible.

In addition to the density control problem, the precursor thus produced requires further processing in order to open the pores for use as precursors in other processes. Further, when dealing with mixtures of particulates, there is a tendency for segregation of the particulates from the liquid components of the mixture as the mix is filling the mold cavity. This is due to differences in flow characteristics between the solids and liquids, density differences, and the varying shear stresses and velocities encountered in the varying thickness of a mold cavity. For that matter, the particulate material itself will segregate according to resistance to flow, generally according to particle size.

Control of porosity and density are very important when the precursor is used for foundry cores and molds. It is desirous not to produce areas in the core and mold having excessively high porosity and low density, as this makes for a weak mold or core, and causes defects such as burn-in. Also, too high a density and too low a porosity is not desirable as gas permeability is consequently low and venting of molding gases is impaired, this leading to gas defects in the casting. A uniform flow of particulates is also required for uniform porosity. In foundry core processes, where particulates do not flow in a fluid manner, density gradients are inherent and deleterious to casting, and are caused by the inability of the particles to flow in a fluidized manner. Particles interlock, forming regions having a higher density than that occurring in the remainder of the piece.

Slip casting produces a porous article directly from the mold. But, slip casting is inherently slow and not capable of very precise or intricately detailed parts. In other processes for producing porous articles, strength, surface finish, permeability and other attributes are adversely affected by lack of control over the porosity and density of the part.

OBJECTS OF THE INVENTION

It is thus an object of the present invention to improve the uniformity of both porosity and density of particulate injection molding to thereby improve dimensional uniformity and other part attributes in subsequent processing, while counteracting stress profiles built into a part as a result of the pressurized injection molding process.

It is a further object of the invention to simplify control of process parameters and to provide a mixture of particulates and liquid binders which utilizes low injection pressures and develops its own internal pressure profile independent of injection molding conditions.

Another object of the invention is to provide a method for producing parts or precursor parts having a controlled density, this being accomplished using prototyping methods such as hand layup molds, and injection using pneumatically operated dispensing guns. The disclosed method also produces parts or precursor parts having open pores and controlled porosity, all without any further processing required.

A still further object of the invention is to accomplish the above without sacrificing shape making ability of the molding process.

Another object of the invention is to simplify and reduce the size and cost of the injection molding press used to inject the material. This is because it is unnecessary to pressurize material in the mold beyond that required to fill the mold, so low molding pressures can be used. In fact, simple molds which can be assembled and disassembled by hand are suitable and can be filled using a pneumatically operated glue gun.

Yet another object of the invention to provide simple, plunger type injection molding presses for high volume applications. The presses can be used to automate the filling, curing, and ejection of parts from the mold.

Finally, it is an object of the invention to provide a system for removing condensate from the vents of the mold. This may consist of a medium in contact with the vents and capable of drawing condensate away from the vents. In this way, condensate material from a curing reaction is removed from the vents without causing the medium to leak through the vents into the mold cavity, or stick to any moving mechanisms. The condensate is either dissolved, filtered, or otherwise collected in the medium.

SUMMARY OF THE INVENTION

Briefly, the invention involves the use of compounds which cure through a certain chemical reaction, called a condensation reaction. The reaction causes both a solid film and a condensate to be produced. By mixing the compounds with particulate material in amounts such that the particulate material can be injection molded as a fluid mixture, the condensation reaction achieves certain of the objectives of the invention. A porous article is produced directly from an injection molding press due to the solid portion of the cured compound forming a film surrounding the particles, and the condensate at least filling the interstices between the particles. The interstices define the volume previously occupied by uncured compound. The pores are open because the compound selected is a species that produces a condensate easily removable from the pores without hindering any desirable performance or quality of the part as a consequence of its use or any subsequent processing of the precursor.

The condensate produced remains in a liquid form throughout the injection molding cycle one of several ways. The compound may be curable at a temperature below the boiling point of its condensate; or, curable at a temperature slightly above the boiling point of the condensate, but with the pressure within the mold (as the part cures) preventing boiling from occurring. The temperature may also be above the normal boiling point of the condensate, but due to the pressures in the mold and/or any additives in the resin, the condensate will not boil.

Because the condensate remains a liquid and at least completely fills the interstices of the particles, a condition of hydraulic pressure equilibrium exists within the continuous pore structure of the part during curing. That is to say, there is a net positive volume change of the mixture as it cures. In addition to the pressurizing effect, as the reaction continues, more and more condensate is produced. This slows, or even stops, the reaction from continuing due to basic chemistry principles such as LeChatelier's principle. Therefore, by selectively removing condensate through vents placed in the mold, the strength of the part can be improved. More importantly, the reaction in the local area of the vent can be accelerated in that local area. Since the curing reaction causes a net positive volume change, strategic placement of mold vents will purposely produce areas having a different density than the remainder of the part. These changes can offset any density gradients created in the part due to filling and packing the mold, or any of the conditions previously discussed.

A shaped part is thus provided for use in subsequent processing without any other processing steps required to effect porosity of the part, a means is provided for controlling the porosity and density gradients in the part and therefore the dimensional accuracy or other attribute of any subsequent processing. This is accomplished in spite of any externally applied pressure required to fill the mold.

Other objectives and advantages of the invention will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1:
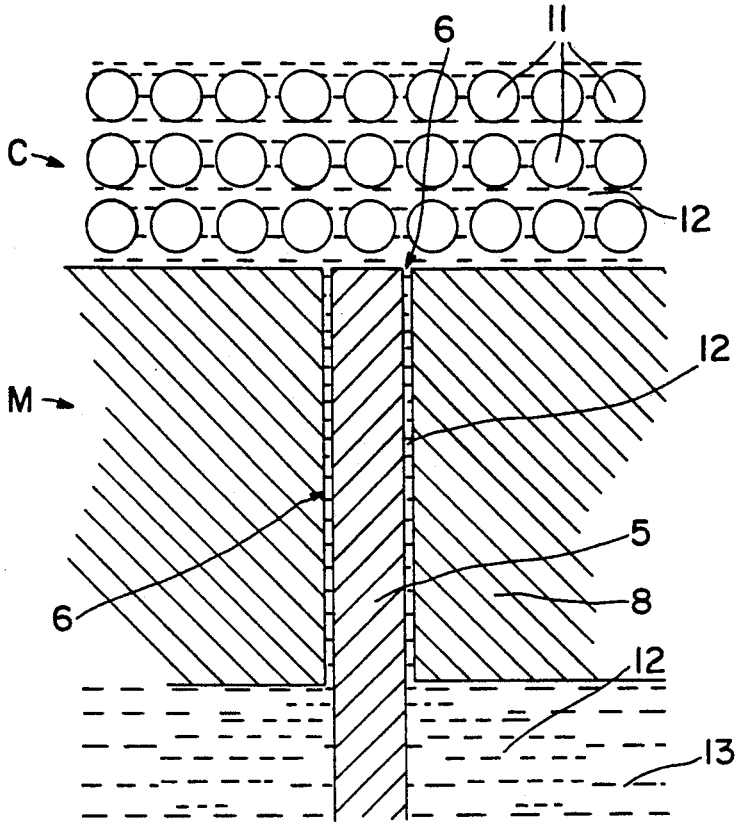
FIG. 1 is a sectional view of a portion of a mold illustrating handling of a condensate.

The method of the present invention involves the use of a thermosetting condensation resin, a catalyst, and a particulate material. In practicing the method of the present invention, thermosetting condensation resins of the furan type consisting of, for example, furan, furfural, furfuryl alcohol, tetrahydrofuran, and bis(hydroxymethyl)furan are preferred. These resins cure both through heat and a pH change, are film formers when cured, and produce water as a condensate. There are many catalysts capable of curing these resins, including organic acids and other acids that lower the curing temperature to a level such that condensate will not boil in a pressurized mold cavity. The preferred catalyst is of the so-called latent type, which is essentially a Lewis acid dissolved in solvent. This is preferred because the curing temperature is lowered over the acid types, and the catalyst can be added directly to the resin and remain stable for months at room temperature.

The catalyst is added to the resin in an amount suitable to cause the curing reaction to occur. Generally, this is 20% of the resin weight. Surfactants and/or viscosity modifiers may also be incorporated into the mix to impart desirable rheological characteristics. The particulate materials, of desired size, shape, size distribution, chemistry, or other property, are weighed out and blended together if necessary. A double planetary mixer with a vacuum hood (not shown) is used to mix the particulates and liquid components together. The vacuum attachment is desired to remove air bubbles from the mixture. Such a mixer/hood arrangement is well-known in the art.

The resultant mixture can be used in several ways depending on the desired end product. For low volume or sample parts, a pneumatic glue gun cartridge (not shown) of the type commonly used to dispense adhesives and sealants, is filled with the mix. With furan type resins, the mixture has low viscosity. In this instance, a glue gun apparatus is suitable for filling sample and short run production molds consisting of several plates or components assembled by hand. The mold assembly contains vents suitable for removal of condensate from the mold while maintaining pressure in the mold. Once filled with the mix, the mold assembly is placed into a heated fixture where the mixture is cured. The assembly is then disassembled by hand.

With the preferred resin/catalyst system, the mold is placed at room temperature between the heated platens of a simple laminating press. The platens are preheated to a temperature around 250° F. (121° C.) which is generally greater than that required for high volume production molding. They are held at that temperature for several minutes. More consistent part properties are produced by providing condensate venting, and secondarily by increasing the hold time in the heating fixture. This is because each part has achieved a high degree of cure.

For high volume parts, an injection molding press equipped with a plunger type injection unit is used to fill molds and mold cavities. These may also be of a more sophisticated design and shape. A feeding system to the press consists of a discharge container with a piston arrangement used to supply the mix to the plunger and barrel of the press. The discharge container may, for example, be the mixing container used with the double planetary mixer referred to above.

Because of the need for accurate metering, timing, and pressurizing during the molding sequence, it is preferred to use a computer controlled, hydraulically actuated injection molding press with a plunger type injection unit. At the beginning of each shot sequence, the press closes the mold, and the nozzle of the injection unit is moved into contact with the mold to seal it. The plunger is then moved a predetermined distance into the barrel of the injection unit to dispense sufficient mix into the mold to just fill the mold cavity. When the mold cavity is full, the speed of the injection plunger slows.

The pressure on the mixture in the mold, called the pack pressure, is monitored to insure the plunger is not exerting excessive pressure on the mixture as the mixture begins to cure. Too much pressure will so tightly pack the mixture in the mold that removal of the cured article is difficult; or, undesired density gradients are produced in the part. A small amount of pressure on the mixture is desirable, however, to insure the mold cavity is completely full, provide for optimum heat transfer conditions, and facilitate the beginning of a condensation reaction. The pressure on the plunger is therefore preferably less than 200 psi. After approximately 30 seconds, the nozzle is pulled back from the mold, and all externally applied pressure is relieved. The production mold is then heated to approximately 230° F. (110° C.), and the mixture is held in the mold cavity for approximately 2 minutes before opening It will be understood that these values may change depending on the size of the part and the type of resin/catalyst used.

FIG. 1 illustrates the preferred handling of the condensate. During the curing reaction, a solid film is produced which coats particulates 11 and leaves a condensate 12 in the pore space between the particulates. In any type of molding arrangement, the curing reaction causes pressurizing of the mix. This is due to the volume changes occurring from evolution of condensate during the curing reaction. Vent pins 5 are inserted through bores or openings 6 in the base 8 of a mold M. Openings 6 extend into the bottom of mold cavity C, and are provided to allow for the escape of condensate 12. In the preferred embodiment of the method, this condensate is water. The size of the openings and the vent pins vary, but the vent pins are, for example, 0.001 inches (0.002 cm.) smaller in diameter than the diameter of the bore. However, the radial gap G between the vent pin and the bore may be greater or lesser depending on the amount of venting desired. As shown in FIG. 1, condensate escapes from the mold cavity by flowing through the gap between the opening and the vent pin. The vent pins may also be used as ejection pins to remove a part from the mold cavity at the conclusion of a molding cycle.

With sample tooling, condensate is allowed to flow freely from the mold into channels or recesses designed to neatly pool and capture the condensate. The condensate is then washed from the channels or otherwise from the mold plates after the part is removed and before the mold is reassembled for the next part. However, a tidier solution is to place a piece of absorbent paper, such as paper toweling, cloth or other absorbent material, on one, or several faces of the cavity to absorb any condensate being given off of the part. Mold disassembly and reassembly is then faster, since the need for clean up is reduced. This has the additional benefit of increasing the strength of the parts and providing more consistent properties due to more efficient condensate removal.

With higher volume production tooling, the uncontrolled release of condensate into the tooling is undesirable due to the possibility of liquid remaining in the mold cavity causing incomplete filling or other molding defects. Furthermore, since some of the resin and catalyst is brought along with the condensate into the vents and mold plates, gumming and sticking between moving components of the mold can occur. The use of condensate absorbers is generally not desired with injection molding due to the surface finish on the part left by the absorbent material and the extra processing time required to handle the absorber. In addition, because high volume production usually involves the use of split cavity tooling and an intricately shaped cavity, absorbent material is difficult to place in position to provide uniform mold venting. Thus, the balanced removal of condensate from the mold to produce uniform density in high volume molded parts is usually not practical using absorbent materials.

Figure 7:
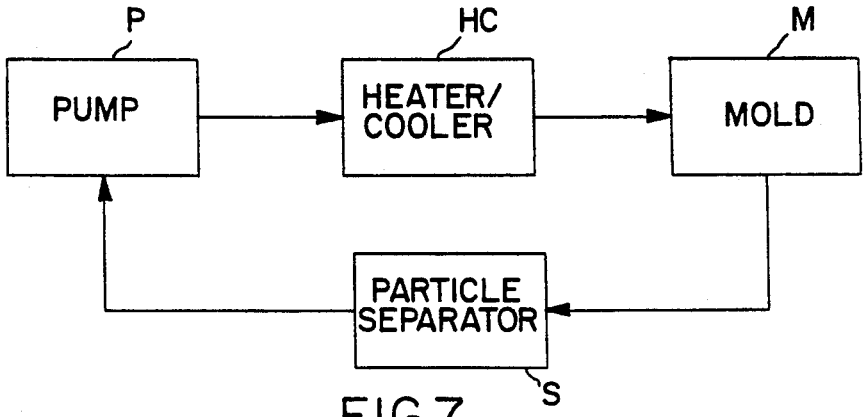
FIG. 7 illustrates a high volume molding operation with a pumping system for condensate removal; and, FIG. 8 is an exploded view of a hand assemblable mold used in practicing the method of the invention.

Referring to FIGS. 1 and 7, it is preferred, with high volume production tooling, that a means be provided for introducing a medium 13 beneath mold cavity C, in contact with vent pins 5 and the end points of other venting pins or channels, in order to continually wash, remove, and contain the condensate material being given off of the mold cavity. Since the preferred resin/catalyst system is water soluble, a circulating fluid is the preferred solution as the condensate removal medium. The circulating medium can be water, ethylene glycol, or other water soluble fluid. The condensate in the preferred method dissolves into the circulating fluid and is carried away from the mold. It will be understood that circulating a medium 13 under pressure may cause it to leak upwardly through gap G into the mold cavity. It is therefore advantageous to use a vacuum pump P to circulate the fluid at less than atmospheric pressure through the mold. If a means HC for heating and cooling the fluid is also provided, the circulating fluid can also serve as a method of controlling the temperature of the mold. Filtering, settling, or otherwise separating particulate material picked up by the circulating medium as it is pumped through the mold should be done to remove the particulate, and any solidified or insoluble resin material, and thereby prevent damage to the pumping system. As shown in FIG. 7, a separator S is provided for this purpose.

In any type of molding arrangement, at the conclusion of a molding cycle, mold M is opened either by hand or by the action of the molding press, and a porous article is removed that conforms to the shape of the mold cavity. By judicious selection of placement of vent openings 6 in the mold, control over the curing reaction in the vicinity of the vents is exercised. As a result, density gradients are induced into the part which counteract the density gradients imposed on the part due to mold filling or externally applied pressures In this manner, a porous article is produced.

The following three examples illustrate various advantages of the invention. In these examples, the same mixture of particulates and binders are used. The recipe specified below is in accordance with the teachings of U.S. Pat. Nos. 5,033,939 and 5,059,387, both to Brasel, for a process for powder metal injection molding.

Megamet Mix Number 54

Particluates

Carbonyl Iron Powder, BASF grade OM: 1750 grams

Water Atomized Iron Powder, Hoeganaes Ancorsteel 100B screened to—120 mesh: 750 grams Polyvinyl Pyrollidone powder: 35 grams Liquids Thermosetting Condensation Resin: Ashland 65-016: 175 grams Catalyst: Ashland 65-058: 35.0 grams Glycerin: 52.5 grams The above were combined and mixed together in a double planetary mixer and vacuum degassed, producing a uniform mixture of toothpaste or cake frosting consistency.

In all of the following examples, the mix number 54 described above is used to produce a precursor suitable for a subsequent sintering step as disclosed in the previous Brasel patents. It will be understood that although the examples of the preferred embodiments of the invention are with respect to the recipe detailed above and the subsequent sintering process, the invention also applies to other particulates including metals, alloys, ceramics, mixtures of metal and ceramics, and other types of thermosetting condensation resins, as well as other subsequent uses such as structural parts, filters, prototyping, casting molds, and casting cores.

EXAMPLE 1

Application of Condensate Venting to Improve Dimensional Accuracy of Injection Molding In this example, three different venting regimes were employed to illustrate how venting can be used to control the density differential inside a part as it cures, and thus effect the final part dimensions in a subsequent process.

Figure 2:
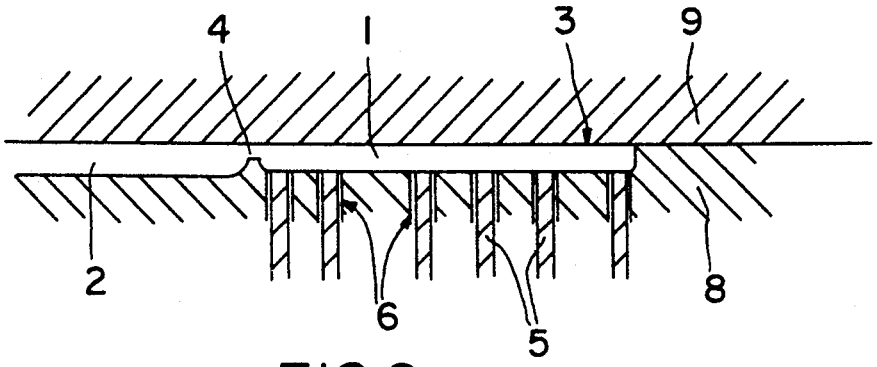
FIGS. 2–4 are sectional views of an injection mold respectively representing a bottom venting, a top venting, and a combined top and bottom venting structure for the mold.

Referring to FIG. 2, which shows a cross-section through a mold M and its mold cavity C, the mix described above was injected into a die primarily containing a rectangular mold cavity 1. Cavity 1 is, for example, of the dimensions 2.025 inches (5.1 cm) by 0.235 inches (0.6 cm) by 0.151 inches (0.4 cm). The mixture entered the cavity through a runner 2 which is so situated that the mixture was forced to travel the greatest distance to fill the cavity. The cavity was configured such that the entire part was produced in the lower plate 8 of the split mold M. As shown, the upper portion 3 of the cavity was defined by a substantially flat upper mold plate 9. An important additional feature of this mold is that a gate 4 by which material is fed into mold cavity 1 has an area equal to approximately one-half of the end of the part. Because of this, any pressure exerted on the mixture while it has filled the mold, and is in a liquid state, will pressurize and compact those portions of the mold that are in a semi-liquid or solid state. This effect is significant for reasons discussed below with respect to FIGS. 2–4.

The three venting regimes used, and their respective illustrative figures were as follows:

FIG. 2: Bottom Venting. Vents consisting of 0.125 inch (0.3 cm) diameter pins 5 are positioned in holes 6. As formed, there is a 0.001–0.002 inch (0.003–0.005 cm) radial gap clearance between the pins and the sidewalls of the openings. Further, the openings are placed at generally regular intervals across the bottom portion of the cavity defined by bottom mold plate 8. The vent pins are also used as ejector pins, and because of this, their location corresponds to the location of certain features of the part. Although not shown in FIG. 2, it will be understood that for certain part features, the spacing may be other than precise regular intervals. In the regime of FIG. 2, there were no vents extending through top mold plate 9 for the part.

Figure 3:
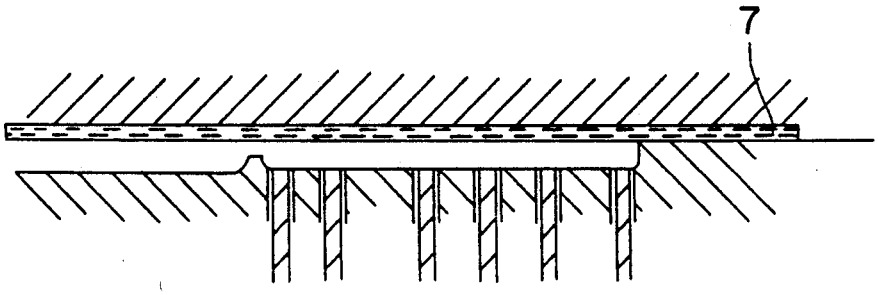

FIG. 3: Top Venting. The same venting arrangement of FIG. 2 was used, except that a sheet 7 of absorbent material was placed over the top of the part, between mold plates 8 and 9. It has been found that an absorbent material is much more efficient at removing condensate than the opening 6/vent pin 5 arrangement in the bottom mold plate. Consequently, it is considered that test results using this regime are qualitatively comparable to using top vent pins alone. In effect, the regime of FIG. 3 is actually a case of extreme top venting.

Figure 4:
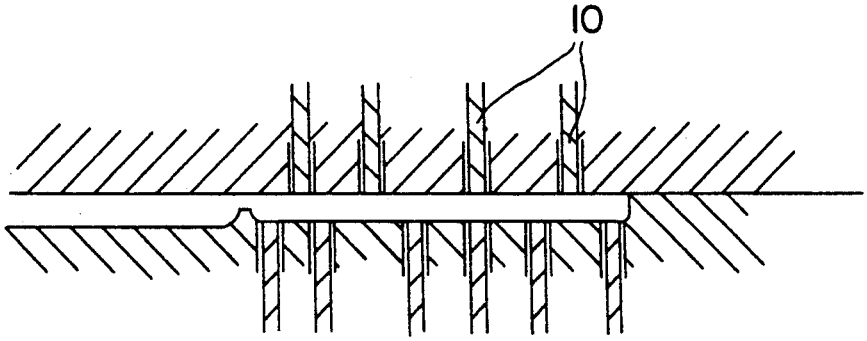

FIG. 4: Top and Bottom Venting. In this regime, condensate absorber sheet 7 was removed and four evenly spaced top vents 10 of the same size and configuration as the lower vents 6 were installed. This regime provides more evenly distributed venting; or, at least more even venting than found in the previous regimes.

Mix number 54, as set forth above, was then prepared and loaded into the injection molding machine where a mold configured for each regime described above was mounted. A computer controlled, closed-loop pressure system on the injection molding machine allowed the investigator to vary the pressure applied to the mixture over a wide range as it cured in the mold. Several dozen parts were produced, using the regimes illustrated in FIGS. 2 and 3.

In order to illustrate the effect of precursor pressurization on the results of subsequent processes, the parts were sintered in accordance with the above referenced Brasel patents to produce metal parts. In performing this step, the parts shrank an average of 7.4%. Any density differences in the parts, which can arise from pressure distribution in the curing process previously discussed, were manifested as dimensional distortions. The distortions took the form of either concave or convex warping of the part with respect to the flatness of the bottom of the part along its 2.025 inch length.

Figure 5:
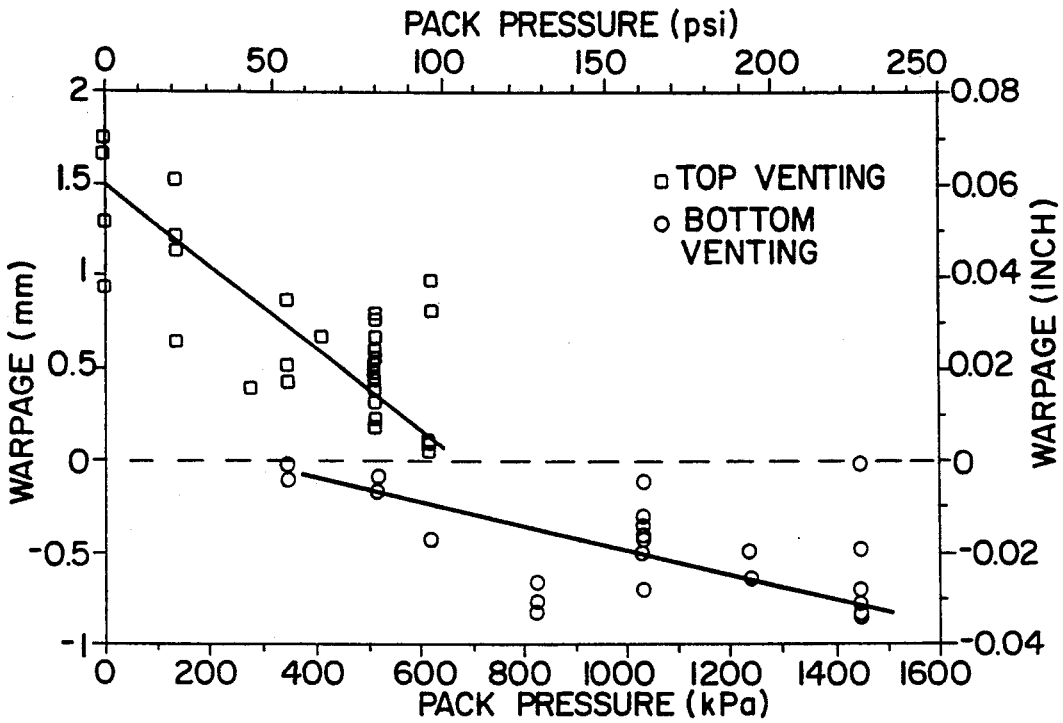
FIG. 5 is a graph representing warpage of a part as a function of packing pressure.

FIG. 5 graphically illustrates the effect of both packing pressure and the venting regimes of FIGS. 2 and 3 on parts warpage. In the graph, a positive warpage indicates the part warped concavely downward toward the bottom of the mold; i.e., the part is "humped up" in the middle compared to the ends of the part. Negative warpage is a concavely upward distortion towards the top of the mold: i.e., the ends of the part are higher than its middle.

From FIG. 5, it appears there exists two different packing pressures, one for each venting arrangement, which would produce minimum warpage. Thus, with top venting, higher pack pressures reduce warpage. With bottom venting, higher pack pressures increase warpage. Explaining why this occurs illustrates how venting can be used to control part dimensions.

When top venting is used, condensate is being removed from the top of the mold, and the curing reaction is promoted in the top of the part. Those skilled in the art will recall that the curing reaction is accompanied by a volume expansion and a decrease in density due to the formation of condensate. However, no expansion or decrease in density can occur at the top of the part because there is no area of the mold cavity available for the particulates to move into. The bottom of the part is not yet cured, so the hydraulic pressure of the liquid portion of the feedstock prevents expansion, and the vents are sized to not allow particulates to pass through. The pressure of volume expansion can only be relieved by condensate release through the vent pins, leaving the particulate density unchanged. However, when the bottom of the part cures, the now cured and porous top of the part can be compacted, much like a sponge. The bottom of the part decreases in density as the hydraulic pressure from the curing reaction compacts the porous structure at the top of the part. The part is thus left with a density differential, high density at the top, low density at the bottom, that will cause a shrinkage differential in sintering and concave down warpage.

Also, as shown in FIGS. 2–4, gate 4 by which mixture is injected into the mold cavity is located in the upper half of the cavity. Consequently, the gate arrangement provides pressure directly to the top of the mold. Pack pressure on the top of the mold will densify the cured porous structure at the top of the part, making it less able to be compacted. Therefore, with top venting, increasing pack pressure effectively decreases the amount of warping by increasingly counteracting the volume expansion of the uncured bottom of the part against the cured top of the part.

Similarly, concavely upward warpage with bottom venting, and its variation with pack pressure, are also explainable. The vents in the bottom of the mold provide a cured, porous structure in the bottom of the part for the top of the part to expand against. This gives low density in the top of the part and high density in the bottom of the part. But, increasing packing pressure with bottom venting and providing a gate in the top of the mold further magnifies density differences since packing pressure increases the density in the bottom of the part. Thus warpage of this type can be reduced by decreasing pack pressure. It is also evident that some densifying occurs in the top of the part also, since the magnitude of the warpage shown in FIG. 5 is much less with bottom venting.

Based on the foregoing analysis, the best venting regime is one which produces the same amount of volume expansion throughout the part. This, in turn, is best accomplished by insuring an even amount of venting throughout the part, and by keeping all external packing pressures to a minimum. Achieving both of these results avoids densifying one portion of the part preferentially to another portion thereof.

To verify this conclusion, forty more samples of the rectangular part were molded and then sintered using the regime depicted in FIG. 4, i.e., top and bottom venting. The packing pressure was slight, 20 psi, and was applied for only a few seconds out of a 2 minute total curing time. The sintering cycle was the same as used for the previous samples. The average amount of warping of these parts was 0.0025 inches (0.006 cm) in a slightly concave upward direction. This is a drastic improvement from the part produced using the regimes of FIGS. 2 and 3. Further, it will be appreciated that just as packing pressure can be used to counteract an undesirable venting regime, the reverse is also true; that is, an appropriate venting regime is useful in counteracting a non-uniform packing pressure.

EXAMPLE 2

Variation of Pressure Profile with Mold Filling Pressure and Uniformity Through Self-Pressurization In the prior art, it is essential that additional pressure be applied to a mixture as it is solidifies to increase the strength and density of the final part, insure that all of the features of the mold cavity are filled, and counteract shrinkage of the mixture as it solidifies. This example illustrates that this additional external pressure imposes a non-uniform pressure distribution on a part. This can lead to non-uniform density and poor dimensional control, both as previously discussed.

An experiment was performed using a condensate absorbing material as a means for indicating the pressure profile within a mold, after the mold is filled with the mixture of particulates and binder. The venting regime shown as in FIG. 3 was used, with cavity C being a rectangular shaped mold cavity. The cavity was filled from one end of the part so the mixture takes the longest path to fill the mold.

For this example, a condensate absorber 7 consisting of an absorbent paper approximate 0.004 inches (0.01 cm) thick was placed over the length of the part adjacent the upper surface of the cavity defined by the flat upper mold plate 9. When the mold was closed and prepared for injection of the mixture, the absorber was pinned between one of the part's long faces and the flat upper mold plate. The mixture was then injected into the cavity using three different pressurization regimes. These were:

Regime 1. High pressure followed by low pressure.

Regime 2. Low pressure followed by high pressure.

Regime 3. No pressure applied after mold filling.

Figure 6A:
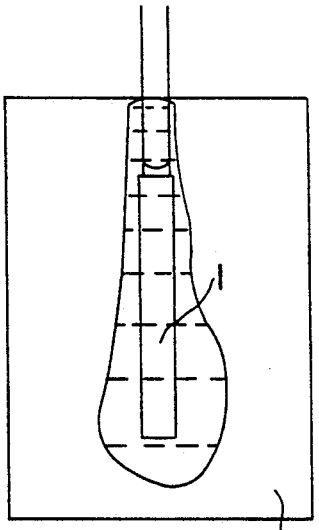
FIGS. 6A–6C represent three respective regimes for injecting a mixture into a mold cavity.
Figure 6B:
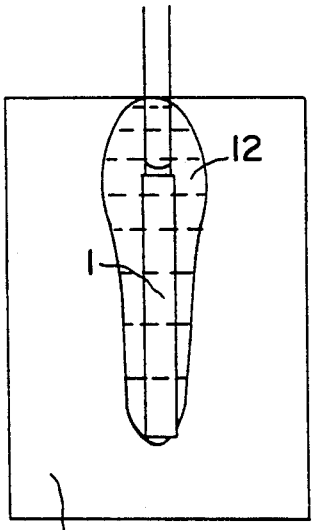
Figure 6C:
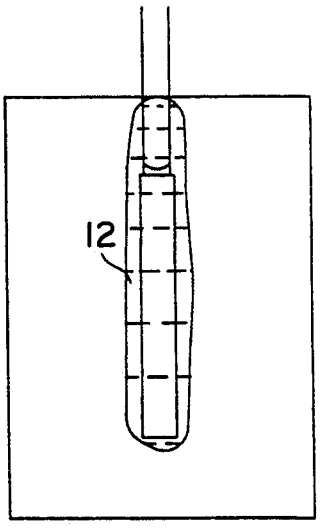

The results of these regimes are illustrated in FIGS. 6A–6C. As shown therein, after each respective pressurization, condensate absorber 7 had a darkened area (the shaded area in each FIG.) caused by the absorption of condensate 12 into the absorber. This darkened area acts as an indicator of the pressure profile in the part while it is solidifying. i.e., more condensate was squeezed into the absorber during the high pressure portion of the injection regime than during the low pressure portion. Thus, the absorber readily illustrates how pressure gradients can be imposed on the part as a function of the required filling and packing pressures.

As seen in FIGS. 6A–6C, each regime produced a different pattern on the absorber left by the condensate. In the regime of FIG. 6A, more condensate was absorbed toward the inner end of cavity C, away from the injection gate 4 end of the cavity, than from the rest of the cavity. In FIG. 6B, which represents the second regime, more condensate was absorbed near the gate end of the cavity than elsewhere. In the third regime shown in FIG. 6C, the condensate was absorbed uniformly from all areas of the part.

Regime 1, which is most typical of a thermoplastic binder compound, produced higher pressures in the solidifying part at the end of the cavity opposite gate 4. This non-uniformity is due to the hydraulic transfer of pressure to this end of the part. When high pressure is applied later in the cycle, as with Regime 2, the portion of the mixture which was first injected, has traveled farthest through the mold cavity, and has been longest in the mold, is more solidified than the portion near the filling end. Because of its advanced level of solidification, hydraulic pressure has little effect on the portion of the mixture at the inner end of the cavity, but is a maximum at the gate end.

Regime 3, shown in FIG. 6C, is, in accordance with the teachings of this invention, preferred for injection molding thermosetting condensation resins. This regime produced the most uniform pressure distribution in the part, as evidenced by the uniform distribution of condensate into the absorber. Therefore, this regime is advantageous for obtaining a uniform pressure profile throughout the cured part.

EXAMPLE 3

Production of Sample Parts with Hand Assemble Molds

Figure 8:
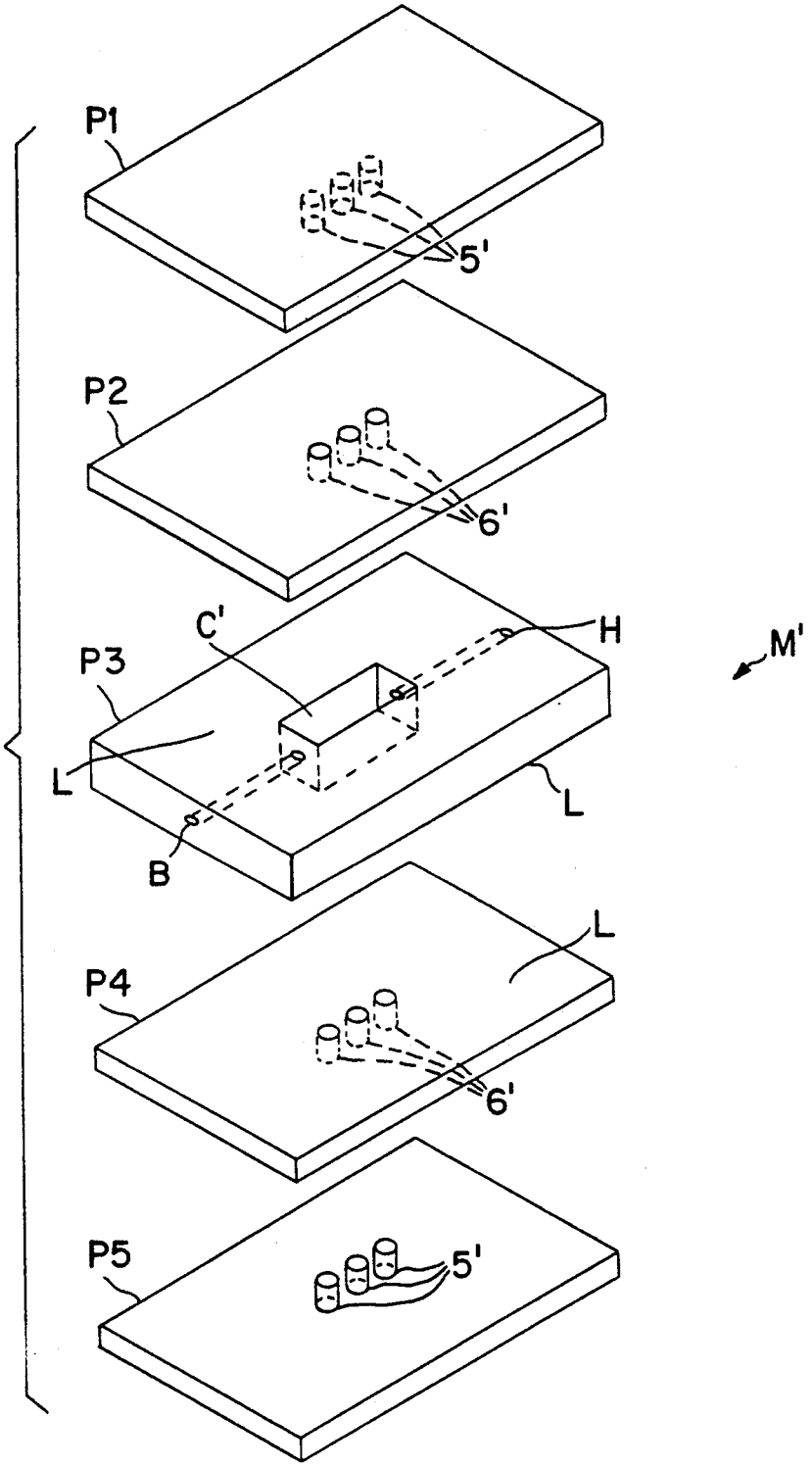

As a result of self-pressurization of the particulate/-binder mixture, selective venting of condensate from the mold cavity, and the inherently low viscosity of the mixture, parts can be produced without the use of an injection molding press. To demonstrate this, a mold M' (see FIG. 8) capable of hand assembly and fastening together was made. The mold was made such that it could withstand the pressure produced by the curing of the resin. The mold was essentially watertight. Vent openings 6' and their associated pins 5' were located where appropriate. Means for completely filling the mold and then heating it were also provided. Formation of the mold was accomplished using five plates P1–P5, sized 4 inches by 2½ inches (10.1 cm by 6.4 cm) and stacked one upon the other. A cavity C' having a desired shape was defined by the innermost plates P2–P4. The cavity shape defined a rectangular test specimen having a length of 1.25 inches (3.2 cm), and cross-section 0.5 inches (1.3 cm) square. The two outside plates P1, P5 each contained three uniformly spaced vent pins 5' contained within bores 6' and having a radial gap clearance of 0.001 inches (0.002 cm).

A pneumatically operated glue dispensing gun produced by Pyles Industries was used to fill the mold. A plastic cartridge, filled with the mix 54 formulated as previously described, was placed into the gun, and approximately 60 psi of air pressure was applied to the cartridge by the action of the gun. An adapting needle of 0.125 inches (0.3 cm) internal diameter was screwed into the end of the cartridge. The needle was inserted into a corresponding bore B in the mold, the bore opening into the mold cavity. When the gun was activated, the mix 54 was forced out of the cartridge, through the needle, and into the mold cavity.

When the mold cavity was filled, this was evidenced by the mix leaking out of a hole H in the mold cavity opposite from bore B. The needle was then removed, and both bore B and hole H were plugged. Now, even though the the mold cavity was completely full, the mix in the mold cavity was unpressurized. The assembled and filled mold was then placed between the 250° F. (121° C.) platens of a hot press with the parting plane L of the mold plates parallel to the platen faces. The platens were now brought into contact with the mold. The use of the press is purely one of convenience, as the action of the platens did not, in any way, pressurize the mix inside the mold cavity. Rather, platen pressure is only used to provide effective heat transfer, and secondarily to provide extra rigidity to the mold assembly. Heating cartridges inside the mold assembly, and a more rigid mold assembly would be more costly, yet would provide the same result.

The mold assembly was left in the press for 5 minutes, this time period being chosen to insure the mix was heated. It should be noted that the time is a function of the mass of the mold plates and may be longer for plates of a larger mass and shorter for plates of a lesser mass. The mold assembly was next removed from the platens and disassembled while still hot. Inside the mold cavity was a hardened porous article in the exact rectangular dimensions of the mold cavity. Further disassembly and inspection of the mold plates disclosed a considerable amount of fluid had flowed out of the mold cavity through the vent pins.

The part was tested for strength using both a durometer test dictated by ASTM Standard D2240 and a modulus of rupture test dictated by ASTM B312. Twenty one samples made in this fashion produced an average modulus of rupture of 45.4 psi and an average Shore A hardness of 82.

In view of the foregoing, it will be seen that the several objects of the invention are achieved and other advantageous results are obtained.

As various changes could be made in the above description without departing from the scope of the invention, it is intended that all matter contained herein shall be interpreted as illustrative and not in a limiting sense.

Having thus described the invention, what is claimed and desired to be secured by Letters Patent is:

1. A method for producing a particulate bearing precursor or a final component either of which has controlled physical properties including porosity and density comprising:

combining a particulate material with a mixture of compounds to form a resultant mixture, the resultant mixture curing to form two species, a solid film which coats and fixes the particulate material in position, and a liquid condensate which more than fills interstices between the particulate material;

filling a mold cavity of a closed mold with the resultant mixture, the mold cavity defining a shape of a three-dimensional part being formed;

heating the resultant mixture within the mold cavity to a temperature at which a curing reaction is initiated but at which the formed condensate does not boil under molding pressure conditions, heating of the resultant mixture occurring in conjunction with or subsequent to filling the mold cavity with the resultant mixture;

simultaneously curing the resultant mixture in the mold cavity to produce the solid film that fixes the particulate material into the part shape defined by the mold cavity, self-pressurizing the closed mold cavity by a volume expansion of the resultant mixture as curing occurs, and expelling the formed condensate from the mold cavity due to the increase in pressure within the mold cavity; and, opening the mold and ejecting the part having controlled physical properties after curing is completed, the controlled physical properties of the part being a result of the curing reaction of the resultant mixture taking place within the closed mold.

2. The method of claim 1 further including selectively expelling condensate from certain portions of the cavity to vary a localized rate of curing of the resultant mixture to effect density or porosity properties of the part in a localized area of the part thereby to control physical characteristics of the part including the part's strength, density distribution, pore size and pre distribution, dimensional accuracy, and pressure profile.

3. The method of claim 2 wherein the mold has an interior and exterior and expelling condensate from the mold includes venting the condensate to the exterior of the mold through bent openings provided in the mold.

4. The method of claim 3 wherein the vent openings comprise respective bores extending through the mold and pins inserted in the bores, and the method further includes venting the condensate by controlling a diameter of the pins relative to a diameter of the bores whereby a radial gap between a pin and its associated bore allows a faster or slower expulsion rate of condensate through the vent opening.

5. The method of claim 4 wherein ejecting the part from the mold involves ejecting the part using the vent pins.

6. The method of claim 3 wherein expelling of condensate from the mold cavity further includes circulating a fluid medium past the vent openings at less than atmospheric pressure.

7. The method of claim 6 wherein the circulated medium is water or a water soluble solution.

8. The method of claim 7 further including filtering the medium to remove condensate and particulates from it, and then recirculating the medium.

9. The method of claim 1 wherein the mixture with which the particulate material is combined to form the resultant mixture comprises a thermosetting condensation resin curable both by heating and by a pH change, and a catalyst consisting of a Lewis acid compound, the Lewis acid compound causing curing of the resin without boiling of the condensate.

10. The method of claim 9 wherein the thermosetting condensation resin primarily consists of one or more of furfuryl alcohol, furfural, furan, tetrahydrofuran and bis(hydroxymethyl) furan.

11. A single-step process of making sample, prototype, or production parts comprising:

assembling together mold components to produce a mold containing one or more mold cavities each of which defines a desired, three-dimensional part shape, the mold components including vents strategically located to allow expulsion of a condensate as a result of self-pressurizing of the mold cavity during a curing reaction of a mixture with which the cavity is filled, which condensate is produced during the curing reaction of the mixture;

preparing the mixture and dispensing the mixture into at least one mold cavity to fill the mold cavity, the mixture being formulated to produce a part having desired physical properties, including part density and porosity, during completion of the curing reaction of the mixture;

initiating the curing reaction of the mixture by heating the mold cavity to a temperature at which the curing reaction is initiated, the self-pressurizing of the mold cavity and expulsion of the produced condensate occurring simultaneously with the curing reaction;

drawing off the expelled condensate; and, removing the produced part from the mold cavity after the curing reaction of the mixture is completed, the desired physical properties of the part, including the density and porosity, being produced by the curing reaction occurring within the mold cavity.

* * * * *

UNITED STATES PATENT AND TRADEMARK OFFICE

CERTIFICATE OF CORRECTION

PATENT NO. : 5,248,457

DATED : Sept. 28, 1993

INVENTOR(S) : Brasel et al.

It is certified that error appears in the above-indentified patent and that said Letters Patent is hereby corrected as shown below:

Column 8, line 48, delete "particluates" and insert therefor --particulates:--
Column 14, line 46, delete "bent" and inser therefor ---vent---;

Signed and Sealed this

Fourth Day of October, 1994

Bruce Lehman

*Attest:*

BRUCE LEHMAN

*Attesting Officer*

*Commissioner of Patents and Trademarks*